United States Patent [19]

Fornoff et al.

[11] Patent Number: 4,961,394

[45] Date of Patent: Oct. 9, 1990

[54] RESCUE OR BATHING RAFT

[75] Inventors: Karl-Heinz Fornoff; Michael Kruska, both of Darmstadt, Fed. Rep. of Germany

[73] Assignee: Nautico Gesellschaft fur Planung und Vertrieb von Rettungs- und-Badeinseln m.b.H., Darmstadt, Fed. Rep. of Germany

[21] Appl. No.: 328,124

[22] PCT Filed: Jul. 29, 1987

[86] PCT No.: PCT/EP87/00409

§ 371 Date: Jan. 31, 1989

§ 102(e) Date: Jan. 31, 1989

[87] PCT Pub. No.: WO88/00904

PCT Pub. Date: Feb. 11, 1988

[30] Foreign Application Priority Data

Jul. 29, 1987 [DE] Fed. Rep. of Germany ..... 3625886

[51] Int. Cl.[5] ..... B63B 35/58

[52] U.S. Cl. ..... 114/266; 441/1

[58] Field of Search ..... 114/264, 266, 267, 258, 114/352; 441/1, 35

[56] References Cited

U.S. PATENT DOCUMENTS 3,893,201 7/1975 Mallory ..... 441/1
4,409,921 10/1983 Carroll et al. ..... 114/352

FOREIGN PATENT DOCUMENTS 1267129 4/1968 Fed. Rep. of Germany ..... 114/264
1531582 3/1970 Fed. Rep. of Germany ..... 114/267
2556601 6/1985 France .

*Primary Examiner*—Joseph F. Peters, Jr.
*Assistant Examiner*—Jesûs D. Sotelo
*Attorney, Agent, or Firm*—Burns, Doane, Swecker & Mathis

[57] ABSTRACT

A floating rescue or bathing island comprising several segment-shaped floating elements linked together to form an annular or circular disk as viewed from above. The floating elements are releasably connected to one another by their lateral surfaces. Each floating element comprises a plastic shell filled by expanded foam.

12 Claims, 2 Drawing Sheets

Fig. 1
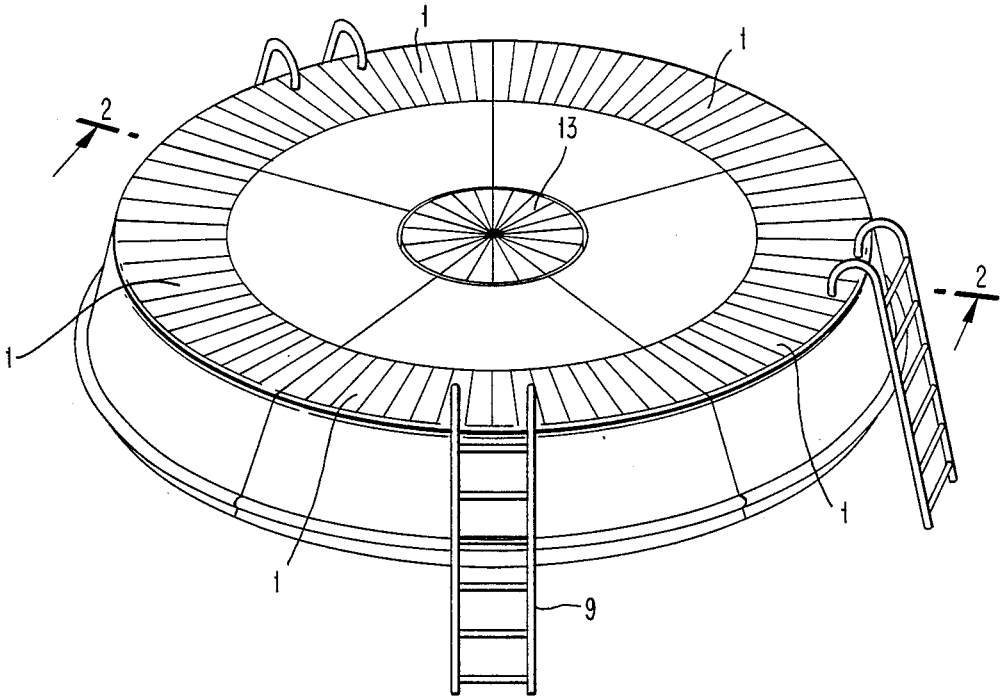
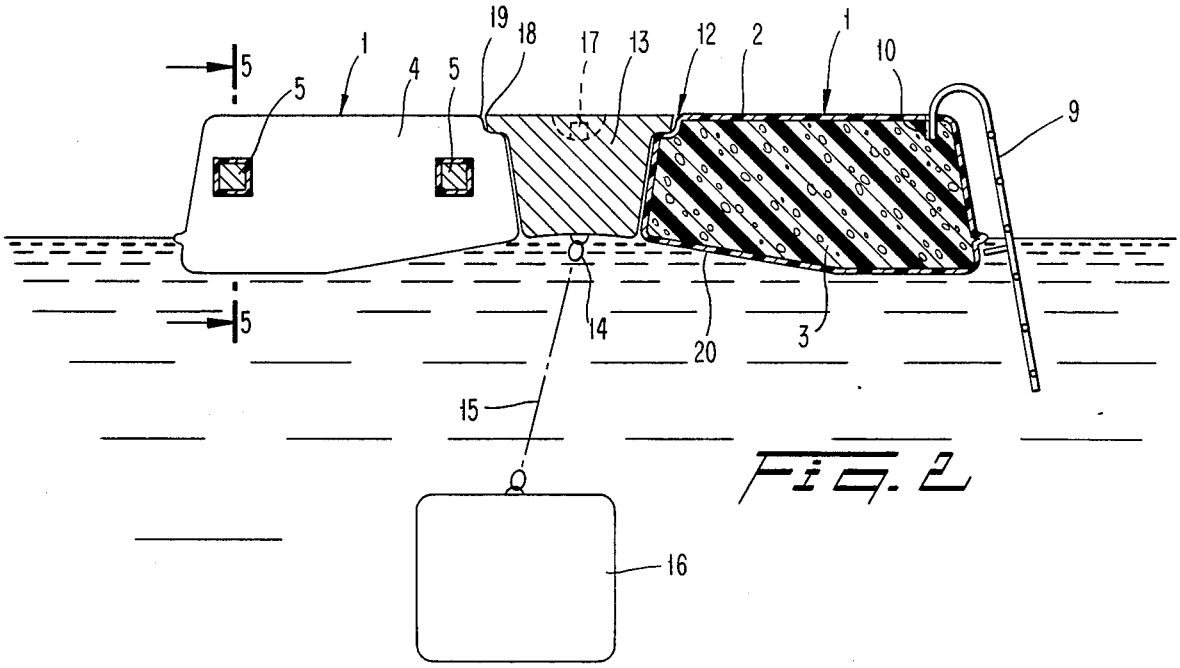
Fig. 2

RESCUE OR BATHING RAFT

BACKGROUND AND OBJECTS OF THE INVENTION

The invention concerns a floating rescue or bathing raft consisting of several interconnected floating bodies.

Rescue and bathing rafts usually are in the form of floats consisting of several rectangular shaped floating bodies. They are anchored in bathing areas of rivers, lakes and other open waters and serve as support points for resting or in emergencies as rescue locations, which are located in front of the bank or shore and may be reached for example even if the safe return of the swimmer is rendered difficult or impossible by a current.

These known rescue or bathing rafts usually form fixedly assembled units which as a rule cannot be dismantled after their assembly. For this reason, the units are difficult to transport; land transportation of the unit without dismantling is in most cases not possible. If these rescue or bathing remain in the water they are at risk of being damaged. Therefore, protected locations must be provided on the bank to store the rafts outside the bathing season.

A floating platform is known from U.S. Pat. No. 4,409,921, which forms in its horizontal projection an annular or circular disk and is composed of several segments. This working platform is intended for insertion in a standing, cylindrical vessel containing inserts in its center axis, so that only an annular space is available to receive a working platform. The individual segments of the working platform have an internal and an external barrel, which in the assembled state form a circle of floats. The floats carry an annular walkway mounted on them.

This working platform is used in a field far removed from the technical area of rescue or bathing rafts. The known floating working platform is not intended for use as a floating rescue or bathing raft and would not be suitable for such a purpose, as its individual parts have sharp edges and would injure swimmers.

It is the object of the invention to create a rescue and bathing raft of the aforementioned generic type, which is easily assembled or dismantled on land and even in the water and the individual floating bodies of which are readily transported and stored, so that their housing in winter storage and their transportation to different locations are possible without difficulty.

SUMMARY OF THE INVENTION

This object is attained according to the invention by that the rescue or bathing raft is a disk annular or circular in its horizontal projection, assembled from a plurality of identical floating bodies forming a segment each, that each floating body comprises a closed, foam filled plastic cup and that the floating bodies are releasably joined together at their lateral surfaces.

The floating bodies are readily transported and stored individually. They may be assembled in a simple manner into an annular or circular rescue or bathing raft, which therefore may be used even in locations that are difficult or impossible to access. Transportation and assembly may be effected without the use of mechanical means of transportation or special tool. For example, rescue swimmers of a rescue station may assemble such a rescue or bathing raft in a rapid and simple manner without additional help and anchor it in the location desired. The rescue or bathing raft may then be retrieved, dismantled and stored after use in an equally rapid and simple operation. According to a preferred embodiment of the invention, each floating body is equipped at one of its lateral surfaces with at least two projecting coupling pins and on its other lateral surface with two matching coupling openings into which said pins may be inserted. A locking bolt serves to hold the coupling pins in the corresponding openings.

THE DRAWINGS

The invention will become more apparent from an example of embodiment described with reference to the drawing, in which:

FIG. 1 shows a rescue or bathing raft in a simplified perspective view,

FIG. 2 a section on the line II—II in FIG. 1,

FIG. 3 a top view of an individual floating body,

FIG. 4 a section on the line IV—IV in FIG. 3 and

FIG. 5 partial section on the line V—V in FIG. 2.

DETAILED DESCRIPTION OF PREFERRED EMBODIMENTS OF THE INVENTION

Figure 3:
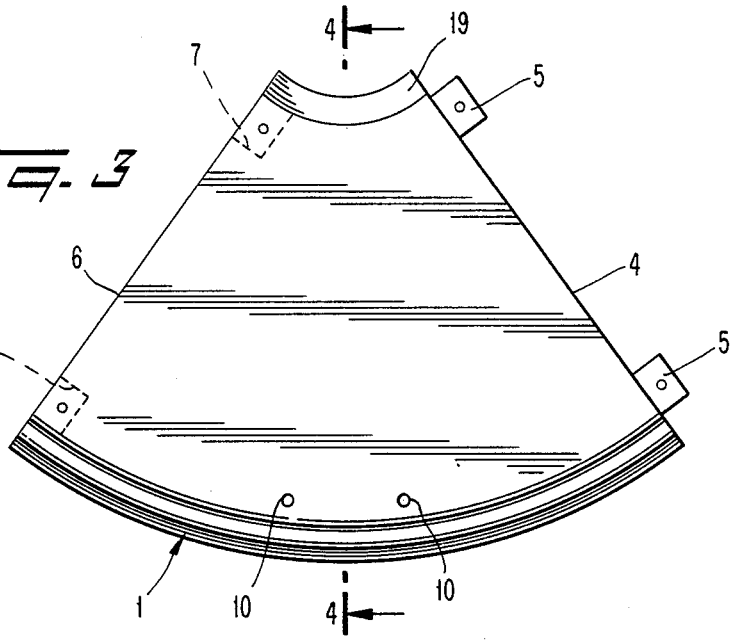
Figure 4:
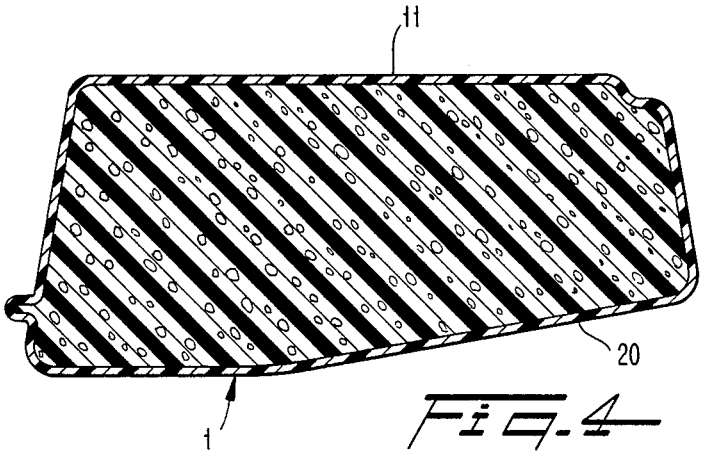
Figure 5:
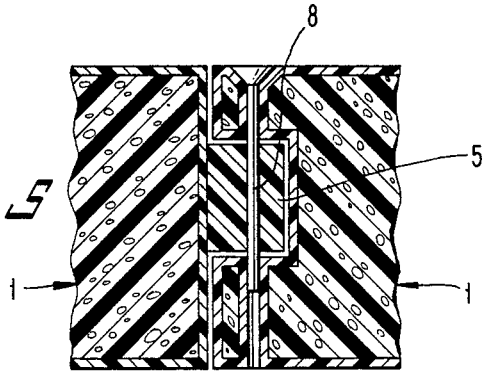

The floating rescue or bathing raft shown in the drawing consists of a plurality of floating bodies 1, each of which is forming a segment and which are joined together so as to form an annular or circular disk, constituting the rescue or bathing raft. The external circumference of the rescue or bathing raft may be circular, as in the example shown, but the outside of the floating bodies 1 may also be such that the assembled rescue or bathing raft is constituting a polygon. Each floating body 1 consists of a closed plastic shell 2, for example of a fiber glass reinforced plastic. The internal space of the floating body 1 is filled with a closed cell, hard plastic foam 3. Two coupling pins 5 are projecting from one lateral surface of each floating body 1, the pins being attached to the body 1 or cast in a single piece Two matching coupling openings 7 are provided in the other lateral surface 6 of the floating body 1. When the floating bodies 1 are assembled, locking bolts 8 are inserted vertically through the coupling pins 5 and the part of the floating body 1 forming the coupling opening 7. In this manner the floating bodies are joined to each other and form segments of the rescue or bathing raft shown in FIGS. 1 and 2. In place of the aforementioned coupling pins, a technically equivalent connection may be used, provided it satisfies safety regulations.

At least one and preferably several of the floating bodies 1 of every rescue or bathing raft is equipped on the outside with a ladder 9, which is hooked on top into insertion openings 10 and secured to the outside of the floating body. The ladder 9 makes it possible for users to climb from the water onto the rescue or bathing raft. A nonslip covering 11 is provided on the top side of the floating bodies 11, which enhances the standing safety of users even in case of a turbulent water surface.

The floating bodies 1 include a central recess 12, into which a ballast insert 13 is placed in order to stabilize the rescue or bathing raft. The ballast insert 13 may be equipped on the bottom side with a lug 14, whereby the rescue or bathing raft is connected by means of an anchor line 15 with an anchor weight 16 resting on the bottom of the water. The top side of the ballast insert 13 may be provided with a counter sunk lug 17, indicated in FIG. 2 by broken lines, to which fastening lines may be attached. The ballast insert 13 has a projecting collar 18 located in a circumferential groove 19 of the floating bodies 1 and holding the ballast insert 13.

The bottom side 20 of each of the floating bodies 1 has a configuration such that it is ascendant at least in part toward the center of the rescue or bathing raft. The major portion of the buoyancy of the floating body 1 is thus produced in the outer zone. This enhances the floating stability of the rescue or bathing raft.

We claim:

1. Floating rescue or bathing raft comprising a disk annular in its horizontal projection, formed by a plurality of floating bodies with each of said bodies forming a segment of the disk, each floating body comprising a closed, foam-filled plastic shell, the floating bodies being releasably joined together at their lateral surfaces, at least one of the floating bodies carrying a ladder on its external side.

2. Floating rescue or bathing raft comprising a disk annular in its horizontal projection, formed by a plurality of floating bodies with each of said bodies forming a segment of the disk, each floating body comprising a closed, foam-filled plastic shell, the floating bodies being releasably joined together at their lateral surfaces, the raft including a central recess defined by the combined floating bodies, said recess containing a ballast insert.

3. Floating rescue or bathing raft comprising a disk annular in its horizontal projection, formed by a plurality of floating bodies, with each of said bodies forming a segment of the disk, each floating body comprising a closed, foam-filled plastic shell, the floating bodies being releasably joined together at their lateral surfaces, the bottom side of each floating body ascending at least in part toward the center of the raft.

4. Rescue or bathing raft according to claim 3, characterized in that each floating body is provided on one lateral surface with at least two projecting coupling pins and on its other lateral surface with two matching coupling openings.

5. Rescue or bathing raft according to claim 4, characterized in that the coupling pin and the part of the floating body forming the coupling opening each has a bore containing a locking bolt.

6. Rescue or bathing raft according to claim 3, characterized in that at least one of the floating bodies carries a ladder on its external side.

7. Rescue or bathing raft according to claim 3, characterized in that the raft includes a central recess defined by the combined floating bodies, said recess contains a ballast insert.

8. Rescue or bathing raft according to claim 3, characterized in that the top side of each of the floating bodies is provided with a non-slip covering.

9. Rescue or bathing raft according to claim 3, characterized in that the plastic shell of each of the floating bodies comprises a fiber glass reinforced plastic.

10. Rescue or bathing raft according to claim 3, characterized in that an internal space of each of the floating bodies is filled with a closed cell, hard plastic foam.

11. Floating rescue or bathing raft comprising a disk annular in its horizontal projection, formed by a plurality of floating bodies, with each of said bodies forming a segment of the disk, each floating body comprising a closed, foam-filled plastic shell, the floating bodies being releasably joined together at their lateral surfaces, the top side of each of the floating bodies provided with a non-slip covering.

12. Floating rescue or bathing raft comprising a disk annular in its horizontal projection, formed by a plurality of floating bodies, with each of said bodies forming a segment of the disk, each floating body comprising a closed, foam-filled plastic shell, the floating bodies being releasably joined together at their lateral surfaces, an internal space of each of the floating bodies being filled with a closed cell, hard plastic foam.

* * * * *